US006817809B2

(12) United States Patent
Choi et al.

(10) Patent No.: US 6,817,809 B2
(45) Date of Patent: Nov. 16, 2004

(54) SEABED OIL STORAGE AND TANKER OFFTAKE SYSTEM

(75) Inventors: Michael S. Choi, Houston, TX (US); Jack H-C. Chan, Houston, TX (US); David P. Tuturea, Houston, TX (US)

(73) Assignee: ConocoPhillips Company, Houston, TX (US)

( * ) Notice: Subject to any disclaimer, the term of this patent is extended or adjusted under 35 U.S.C. 154(b) by 0 days.

(21) Appl. No.: 09/818,117

(22) Filed: Mar. 27, 2001

(65) Prior Publication Data

US 2002/0141829 A1 Oct. 3, 2002

(51) Int. Cl.[7] ..... B65D 88/78; B63B 35/44

(52) U.S. Cl. ..... 405/195.1; 405/210; 166/350; 114/230.13

(58) Field of Search ..... 405/195.1, 210; 114/230.13; 166/350, 351, 352, 355, 367

(56) References Cited

U.S. PATENT DOCUMENTS

| | | | | |
|---|---|---|---|---|
| 2,383,840 A | | 8/1945 | Benckert | 222/95 |
| 3,479,673 A | * | 11/1969 | Manning | 114/230.13 |
| 3,645,415 A | * | 2/1972 | Phelps | 220/507 |
| 3,835,653 A | * | 9/1974 | Hix, Jr. | 405/210 |
| 3,855,809 A | | 12/1974 | Westling | 61/46.5 |
| 4,059,065 A | | 11/1977 | Clark et al. | 114/256 |
| 4,069,529 A | * | 1/1978 | van Heijst | 114/230.13 |
| 4,138,751 A | * | 2/1979 | Kentosh | 114/230.13 |
| 4,182,584 A | * | 1/1980 | Panicker et al. | 405/224.3 |
| 4,279,066 A | * | 7/1981 | Riley | 165/183 |
| 4,413,844 A | * | 11/1983 | N'Guyen et al. | 285/16 |
| 4,604,961 A | * | 8/1986 | Ortloff et al. | 114/230.12 |
| 4,766,836 A | | 8/1988 | Behar et al. | 114/256 |
| 5,582,252 A | | 12/1996 | Richmond et al. | 166/352 |
| 5,816,183 A | * | 10/1998 | Braud et al. | 114/230.13 |
| 5,885,028 A | | 3/1999 | Blanchard et al. | 405/210 |
| 5,899,637 A | | 5/1999 | Blanchard et al. | 405/210 |

FOREIGN PATENT DOCUMENTS

| | | |
|---|---|---|
| FR | 2 186 955 | 1/1974 |
| FR | 2 200 862 | 4/1974 |
| GB | 466985 | 6/1937 |

OTHER PUBLICATIONS

Translation of FR 2186955 "Device for undersea storage of petroleum and for offshore mooring and loading of oil tankers".*

International Search Report, dated Jul. 30, 2002, 2 pages.

* cited by examiner

*Primary Examiner*—John Kreck
(74) *Attorney, Agent, or Firm*—Osha & May L.L.P.

(57) ABSTRACT

An offshore oil storage and offtake system is disclosed. The system includes a storage tank attachable to the seabed and adapted to store hydrocarbons. At least one fluid channel is included which has a first end positioned inside of the tank proximal a bottom of the tank and a second end in fluid communication with seawater outside of the tank. The system also includes at least one offload line having a first end coupled to and in fluid communication with the tank proximal a top of the tank and a second end adapted to be fluid coupled to the tanker and accessible from a water surface. The system further includes at least one hawser having a first end operatively coupled to the tank and a second end adapted to be accessible from the water surface and attachable to a tanker to anchor the tanker during tanker offtake operations.

24 Claims, 14 Drawing Sheets

FPSO with Integral Storage

SEABED OIL STORAGE AND TANKER OFFTAKE SYSTEM

BACKGROUND OF INVENTION

1. Field of the Invention

The invention relates generally to offshore oil production and, more particularly, to offshore oil storage that can be used for deepwater applications.

2. Background Art

A major factor in determining whether or not to exploit an offshore oil and gas field is the feasibility of handling and transporting the hydrocarbons to market once they are produced. Generally, hydrocarbons produced offshore must be transported to land-based facilities for subsequent processing and distribution. Temporary storage may be provided at the offshore production site for holding limited quantities of hydrocarbons produced and awaiting transport to shore. In some cases, equipment is also provided at the offshore production site for separating and/or treating the produced hydrocarbons prior to storing and transporting them to shore.

In the case of an offshore production facility located relatively close to shore, hydrocarbons produced may be feasibly transported to shore through a pipeline system extending from the offshore site (e.g., offshore platform or subsea wells) to the shore along the ocean floor or seabed. This type of pipeline system is typically preferred, when feasible, because it permits the constant flow of hydrocarbons to shore regardless of the weather or other adverse conditions.

However, in some parts of the world, the use of a seabed pipeline system for transporting hydrocarbons to shore may result in expensive pipeline tariffs.

For offshore facilities located a great distance from shore, construction of a pipeline to shore is typically not practicable. In these cases, floating vessels, known as tankers, are used to transport hydrocarbons to shore. Tankers are specially designed vessels which have liquid hydrocarbon storage (or holding) facilities, typically, in the hull of the vessel. In the case of crude oil production, water, vapor, and other impurities are typically removed from the oil prior to offloading the oil onto tankers for transport. In some cases, tankers include additional equipment for separating and treating crude oil prior to storage and transport.

Because tankers float on the water surface, their operations are largely dependent upon surface conditions, such as wind, wave, and current conditions. Thus, tankers are typically not operated during severe or unfavorable conditions. Additionally, operation of a particular tanker may be interrupted periodically for maintenance and repairs. Due to the large expense associated with maintaining tankers, tankers may also be shared among several offshore sites. As a result, long delay periods may occur between tanker availability for a particular site. Therefore, it is desirable to have storage facilities available at the offshore site to avoid the need to "shut-in" (or halt) production due to tanker unavailability. Additionally, offshore storage may be desired to allow for continuous production operations, independent of tanker hook-up and disconnect operations, as discussed below.

Examples of existing offshore production and storage systems used for deepwater applications are illustrated in FIG. 1 and in FIGS. 2A–2D. FIG. 1 shows one example of a production platform 2 used in a deepwater application. This platform 2 includes processing and storage equipment 4 for separating and treating crude oil collected from subsea wells 6 and storing a limited quantity of the processed oil when transport is not available. Because the surface area and weight carrying capacity of the production platform 2 is extremely limited, storage facilities provided on a platform 2 are limited in size and, thus, inadequate for handling large quantities of hydrocarbons which may be produced during periods of shuttle tanker or other hydrocarbon transport unavailability.

FIG. 2A shows a floating production, storage, and offloading (FPSO) system 10 which comprises a tanker 11 specially equipped to function as an offshore production facility. The FPSO tanker 11 is permanently moored at the offshore site and connects to the subsea wells or subsea production gathering system 14 through one or more flowlines 18 connected to the production inlet 16 of the FPSO tanker 11. During production operations, produced hydrocarbons are received, directly or indirectly, from the subsea wells 14. Once on the FPSO tanker 11, hydrocarbons are processed and temporarily stored. Hydrocarbons stored on the FPSO tanker 11 are periodically transferred onto a shuffle tanker 12 temporarily positioned in the vicinity of the FPSO tanker 11 during the transfer. Because FPSO systems 10 comprise surface vessels, they are susceptible to severe weather conditions, during which production must be interrupted and the flowlines 16 leading to the FPSO tanker 11 disconnected. Furthermore, positioning of the shuttle tanker 12 close to the FPSO tanker 11 for hydrocarbon transfer is typically limited to relatively calm weather conditions. As a result, the storage space on the FPSO system 10 may become full and production may have to be halted until a shuttle tanker 12 for offloading is provided.

FIG. 2B shows one example of a floating storage and offloading (FSO) system 20, which is a pure form of ship-based storage without production facilities on board. Using this type of storage system, produced hydrocarbons from a production platform 22 are transferred to an FSO vessel 26 via a flowline (not shown) extending from the production platform 22 to the FSO system 20. Hydrocarbons transferred to the FSO vessel 26 are stored, typically in the hull of the FSO vessel 26. From the FSO vessel 26, produced hydrocarbons are periodically offloaded onto a shuttle tanker 24 for transport to shore. As in the case of the FPSO system 10 discussed above with reference to FIG. 2A, production operations which depend upon an FSO system 20 for storage may be susceptible to production interruptions due to severe weather conditions. Also, during periods when a shuttle tanker 24 is not available for offloading the storage facility on the FSO vessel 26, it may become fall requiring interruption of production until a shuttle tanker 24 is available.

FIG. 2C is an illustration of a direct shuttle loading (DSL) system 30. In a DSL system 30 hydrocarbons produced from subsea wells 33 are collected at an offshore production gathering system, in this case a production platform 32, and directly offloaded onto a shuttle tanker 34, 38 when available, through a flowline 36. For the DSL system shown in FIG. 2C, hydrocarbons are loaded onto one shuttle tanker 34 for transport to shore while another shuttle tanker 38 waits nearby for subsequent offloading after the first tanker 34 is fall and en route to shore. Like other tanker-based storage systems described above, production operations which use DSL systems 30 are susceptible to interruptions in production due to severe weather conditions and periods of shuttle tanker unavailability. Additionally, the use of a DSL system 30 may require operation of a larger shuttle tanker fleet because the presence of at least one shuttle tanker 34, 38 is required at substantially all times in order for production operations to continue. Further, in cases where no temporary storage is provided at the production site, hydrocarbon production will be interrupted every time a shuttle tanker 34, 38 is connected or disconnected for offloading and transport.

Production platforms have also been developed to integrate oil storage into the hull 44 of a platform, such as a SPAR platform 40 as shown in FIG. 2D. However, in cases involving significant production volumes, this storage is not adequate during periods of tanker unavailability. Thus, frequent tanker hook-ups to the platform 40 will still be required. In such cases, even a system comprising a platform 40 with integral storage is still too dependent upon the presence of a shuttle tanker 42.

Other offshore storage systems for deepwater applications may also include smaller thick-walled tanks designed to be sunk to the seabed and internally controlled from the surface. Because the interiors of these tanks are completely isolated from the surrounding seawater environment, these tanks require very thick walls to withstand the hydrostatic pressure difference between the subsea environment and the platform environment. As a result, these systems are expensive and limited in capacity. These systems also require additional equipment such as pumps, controls, and other instrumentation, for monitoring and controlling the internal tank environment and moving fluids in and out of the tanks.

Other offshore storage systems exist for use in shallow water applications; however, for the most part, these systems are not applicable for use in deepwater applications.

In view of the above, a need exists for a cost-effective storage system that can be used for deepwater production operations which provides adequate facilities for storing hydrocarbons and acts as a buffer between tanker loadings. Having such a storage system may avoid the need to halt production until tanker availability and may help to increase the profitability of an offshore production site or to increase the feasibility of developing production sites in remote offshore locations.

SUMMARY OF THE INVENTION

The invention relates to a system for storing liquid hydrocarbons, such as oil, in a tank located on a seabed and offloading the stored hydrocarbons from the tank onto transport vessels when they are available for transporting hydrocarbons to shore. Embodiments of the invention may be used in conjunction with an offshore production facility, such as an offshore platform, or a subsea production and processing system. Embodiments of the invention may also, advantageously, provide a more feasible large capacity hydrocarbon storage option, particularly for deepwater hydrocarbon production.

In one embodiment the system includes a storage tank attachable to the seabed and adapted to store hydrocarbons therein. The system also includes at least one fluid channel having a first end positioned inside the tank proximal the bottom of the tank, and a second end in fluid communication with seawater outside of the tank. The system also includes at least one offload line having a first end coupled to and in fluid communication with the tank proximal a top of the tank and a second end adapted to be fluid coupled to a tanker and accessible from a water surface. The system further includes at least one hawser having a first end operatively coupled to the tank and a second end adapted to be accessible from the water surface and attachable to a tanker to anchor the tanker during tanker offtake operations.

Other aspects and advantages of the invention will be apparent from the following description and the appended claims.

DETAILED DESCRIPTION

Figure 1:
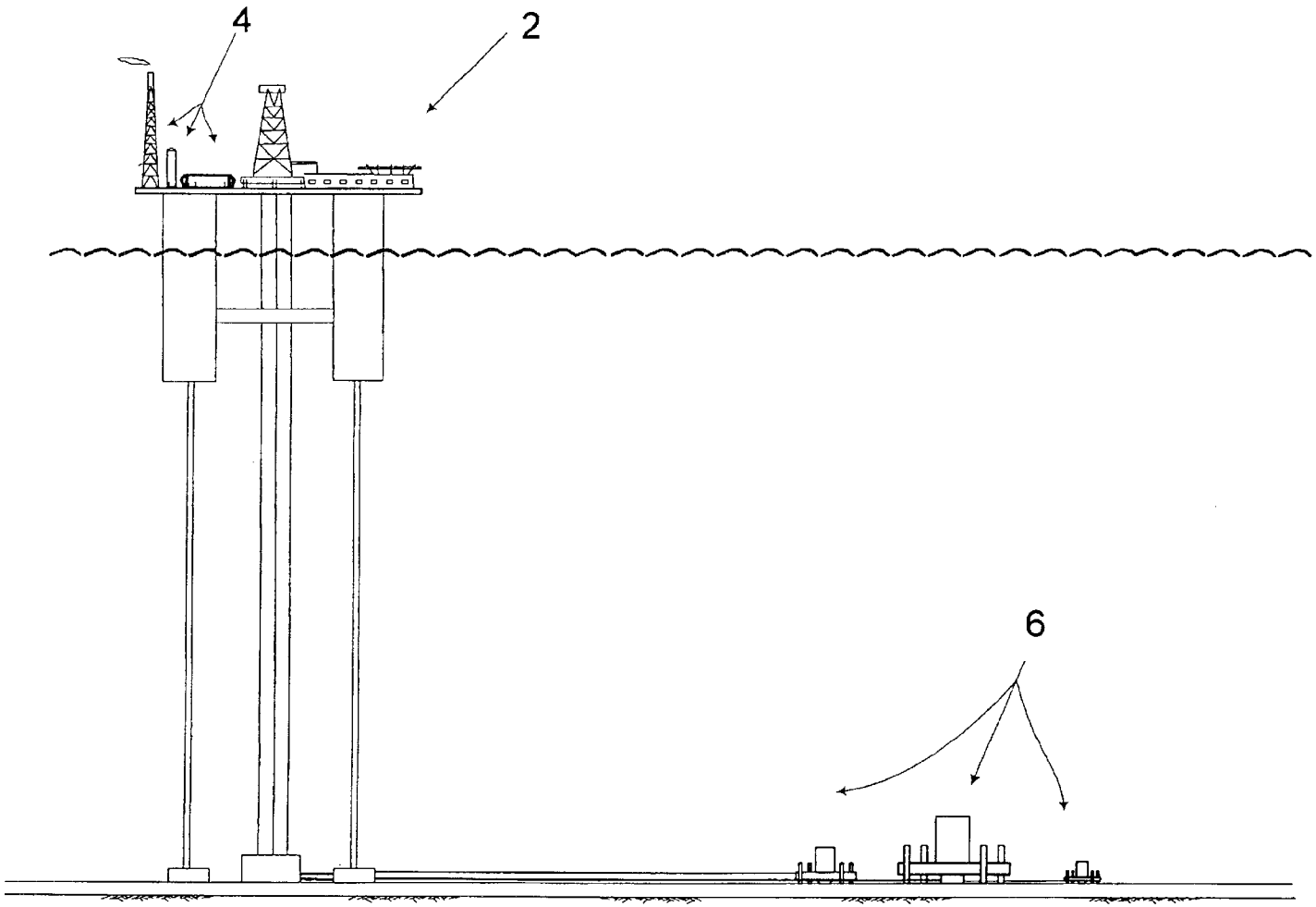
FIGURE 1 (PRIOR ART)
FIG. 1 shows a prior art offshore production platform with processing and storage equipment on the platform.
Figure 2A:
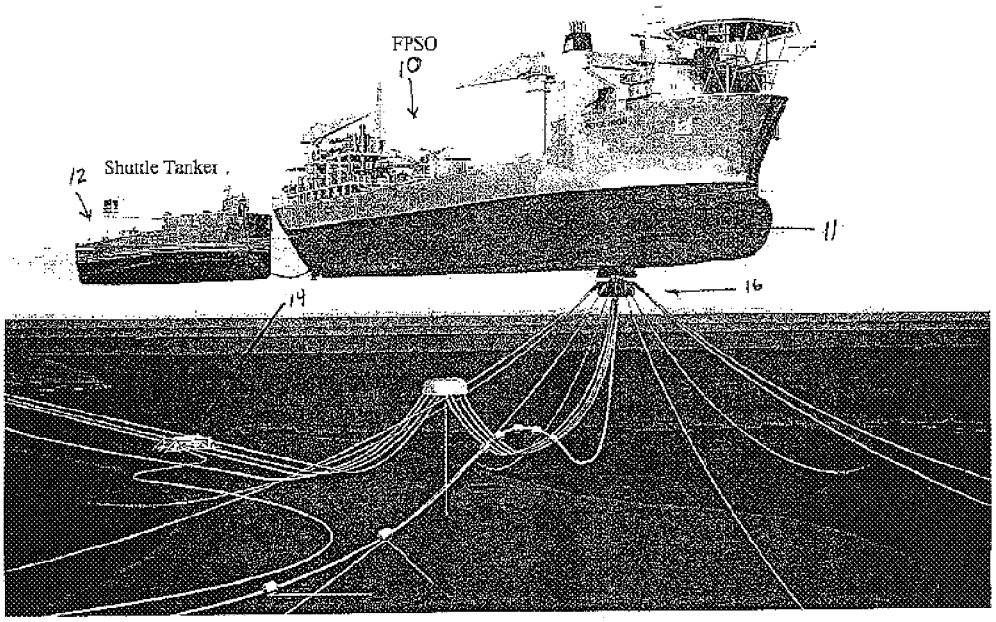
Figure 2A (Prior Art)
FIG. 2A is an illustration of a prior art Floating Production, Storage, and Offloading systems.
Figure 2B:
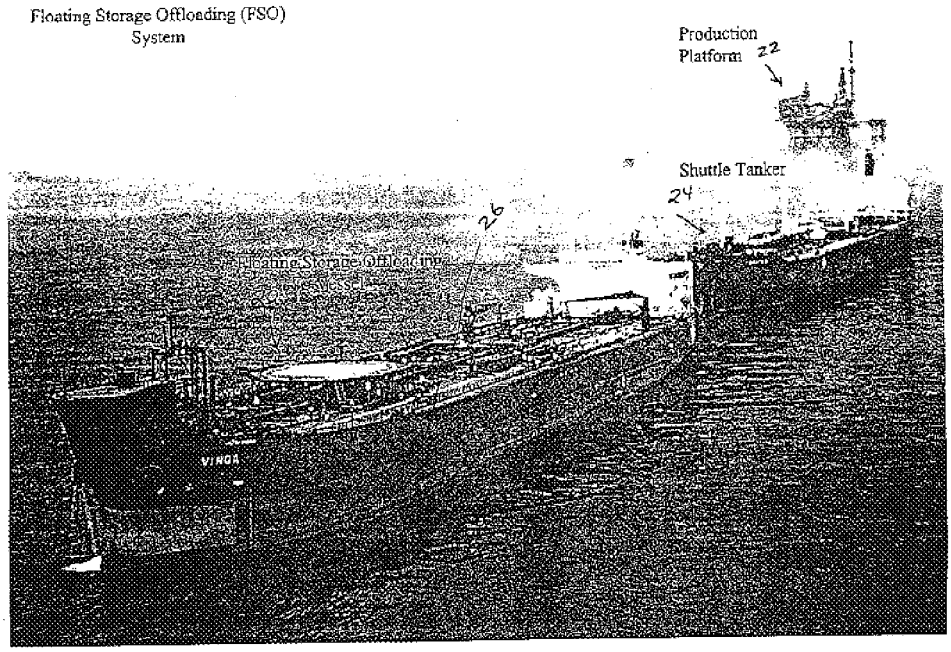
Figure 2B (Prior Art)
FIG. 2B is an illustration of a prior art Floating Storage and Offloading system.
Figure 2C:
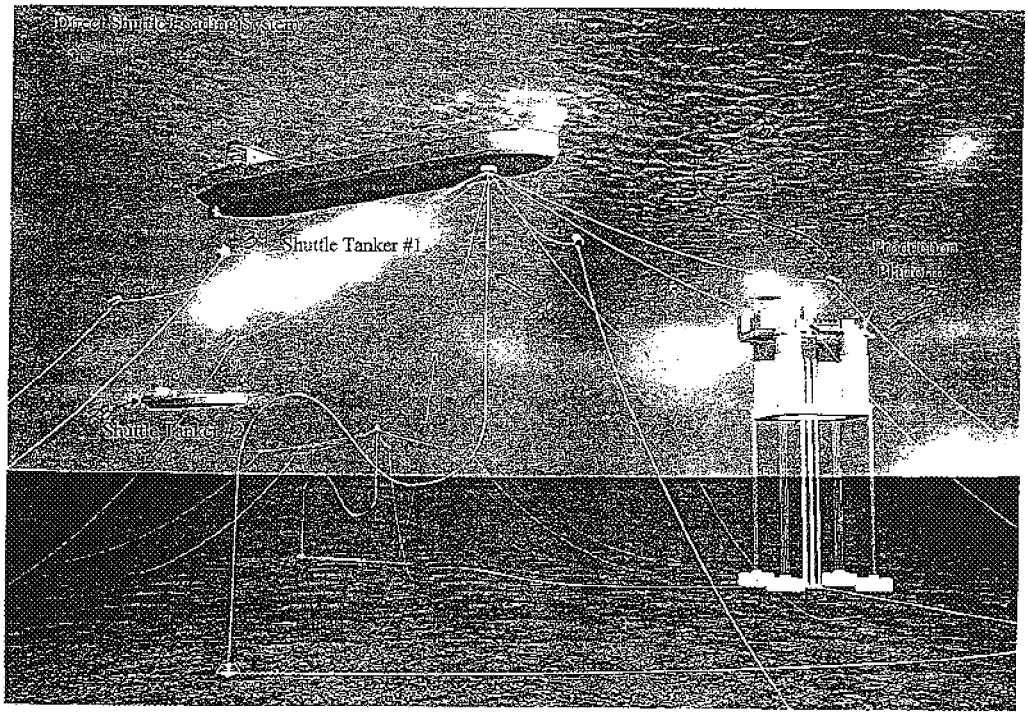
Figure 2C (Prior Art)
FIG. 2C is an illustration of a prior art Direct Shuttle Loading system.
Figure 2D:
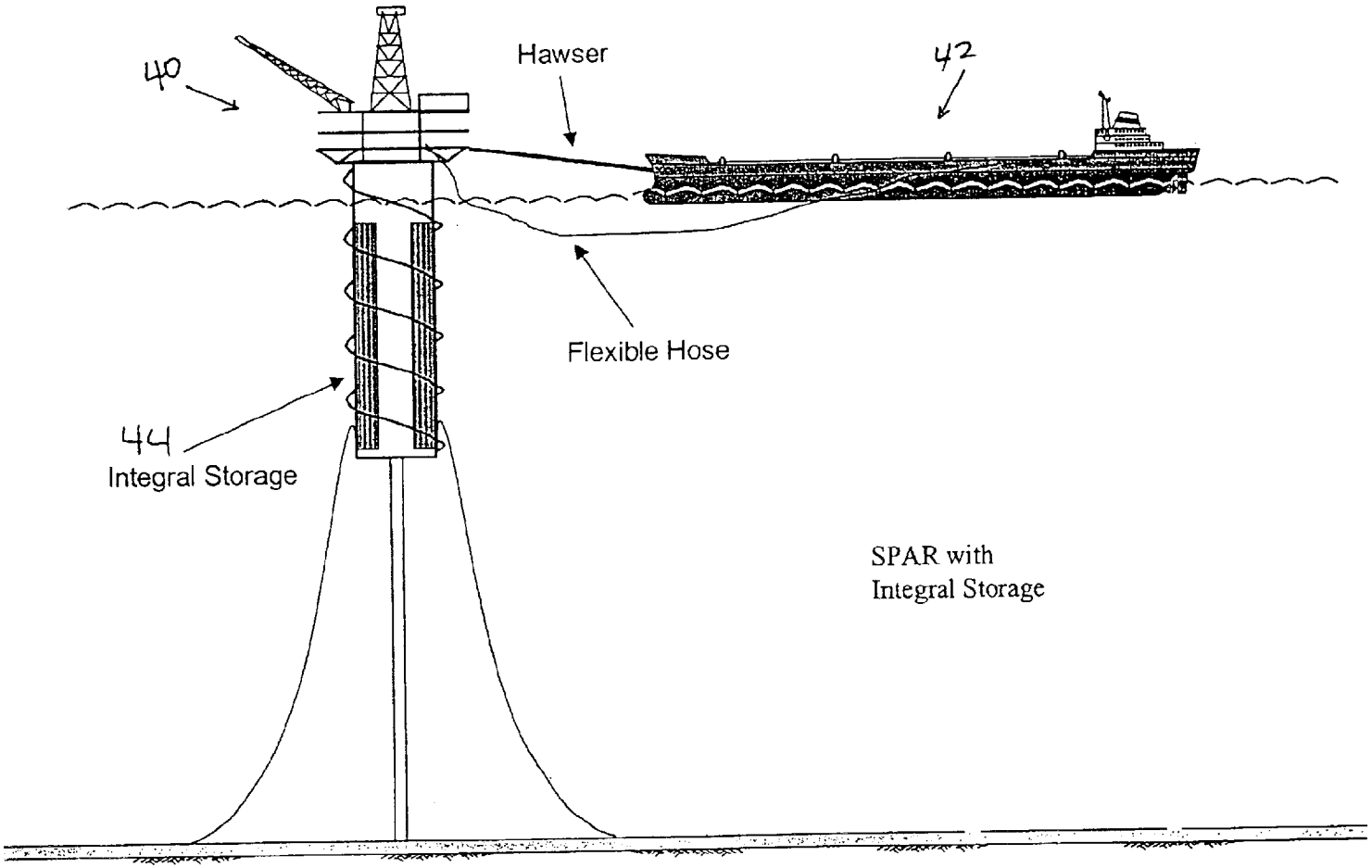
Figure 2D (Prior Art)
FIG. 2D shows a prior art SPAR platform with an integral storage facility.
Figure 3:
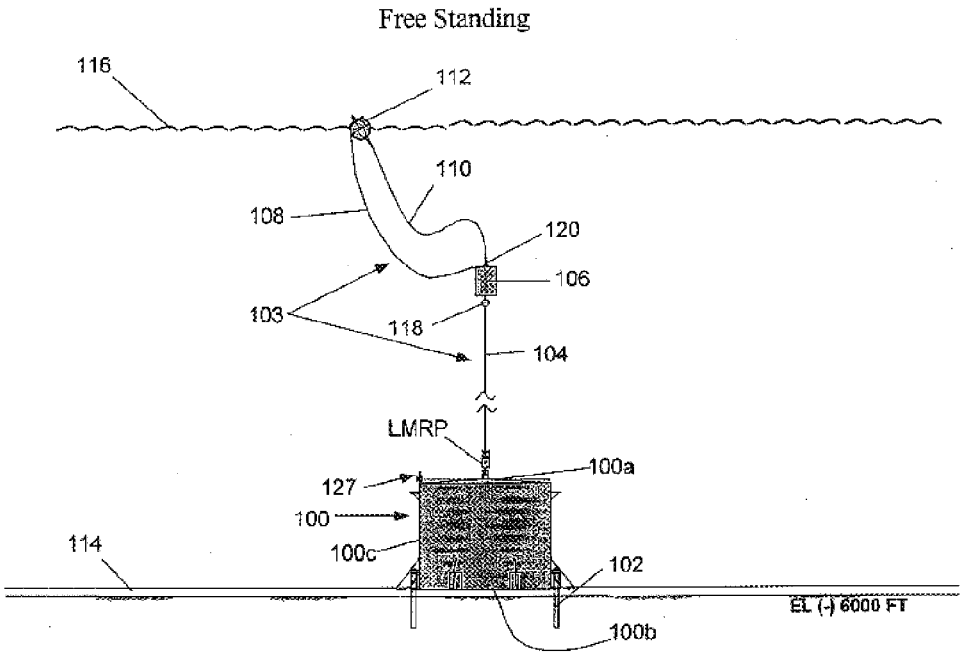
FIG. 3 shows an embodiment of a seabed oil storage and offtake system in accordance with the present invention.

Referring to the drawings wherein like reference characters are used for like parts throughout the several views, FIG. 3 shows one embodiment of a seabed hydrocarbon storage and offtake system in accordance with the present invention. The storage and offtake system comprises a storage tank 100 adapted for placement on and, preferably, attachment to the seabed 114. The tank 100 comprises a top 100*a*, a bottom 100*b*, and one or more side walls 100*c*. At the base of the tank 100, there is an amount of fixed ballast, such as sand, concrete or other dense material, to provide submerged weight to overcome the buoyancy force of the hydrocarbon when the tank 100 is filled to its maximum storage capacity.

The tank may comprise any configuration as determined by one skilled in the art, including cylindrical-shaped, box-shaped, or the like. Those skilled in the art will appreciate that the configuration of the tank is a matter of convenience for the system designer. For example, in a particular embodiment, the tank may comprise a box-shaped configuration and a web-framed steel structure so that it may be constructed using standard ship building techniques, launched from conventional shipways, and have stable floatation for open-water tow.

Figure 5:
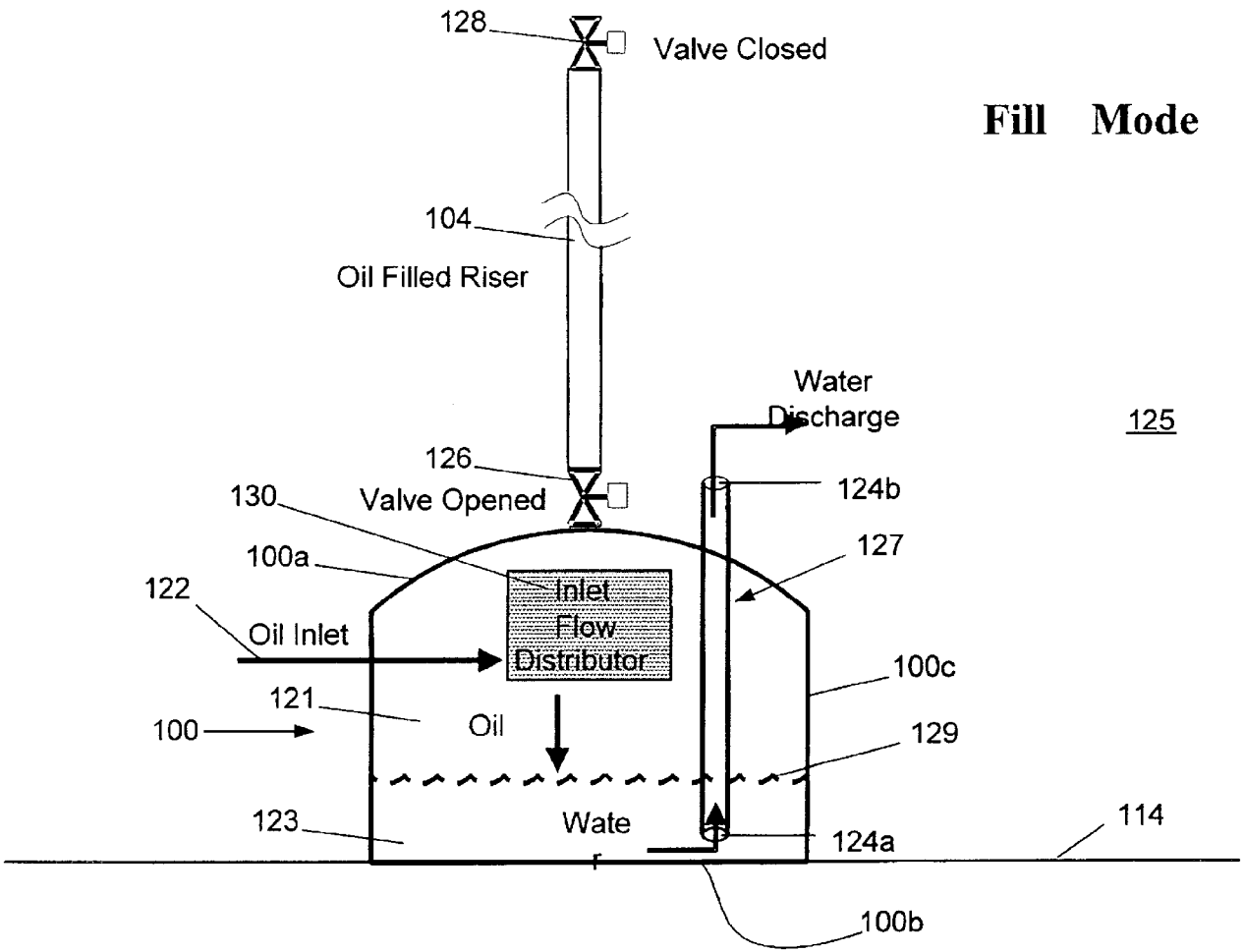
FIG. 5 is an illustration of an embodiment of a seabed oil storage and offtake system in oil fill mode.
Figure 6:
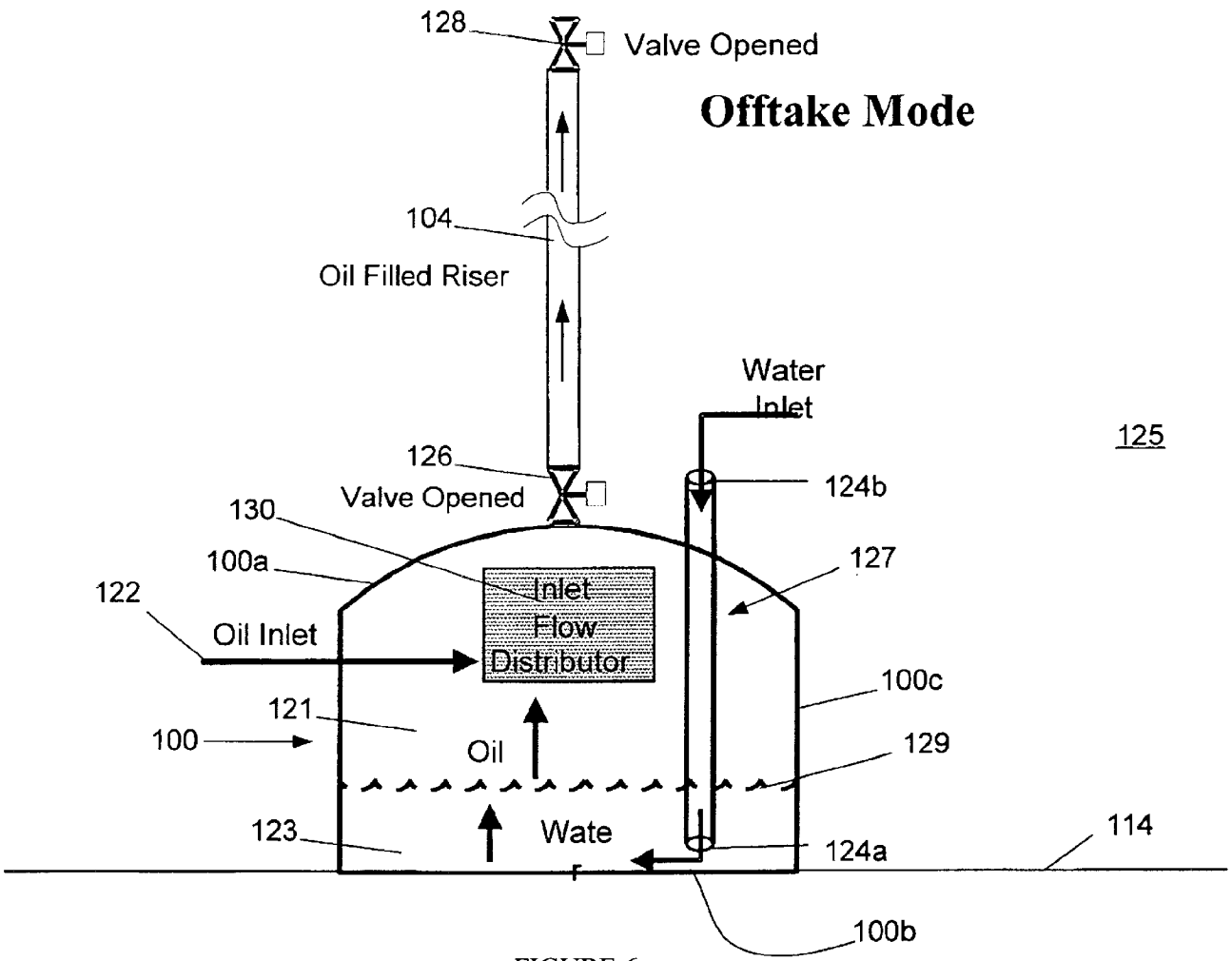
FIG. 6 is an illustration of an embodiment of a seabed oil storage and offtake system in oil offtake mode.

The storage and offtake system further comprises at least one fluid channel 127, such as a standpipe more distinctly illustrated in FIGS. 5 and 6. As shown in the embodiment in FIGS. 5 and 6, the fluid channel 127 has a first end 124*a* positioned inside of the tank 100 proximal the bottom 100*b* of the tank 100 and a second end 124*b* in fluid communication with the seawater environment 125 outside of the tank 100. Preferably the second end 124*b* is positioned away from the seabed (114 in FIG. 3).

Referring once again to FIG. 3, the storage and offtake system further comprises at least one offload line 103. The offload line 103 comprises a first end coupled to the tank 100 and in fluid communication with the interior of the tank 100 proximal the top 100*a* of the tank 100. A second end of the offload line 103 is adapted to couple in fluid communication to a transport vessel (illustrated in FIG. 4) and to be accessible, in a manner which will be further explained, from the water surface 116.

Figure 4:
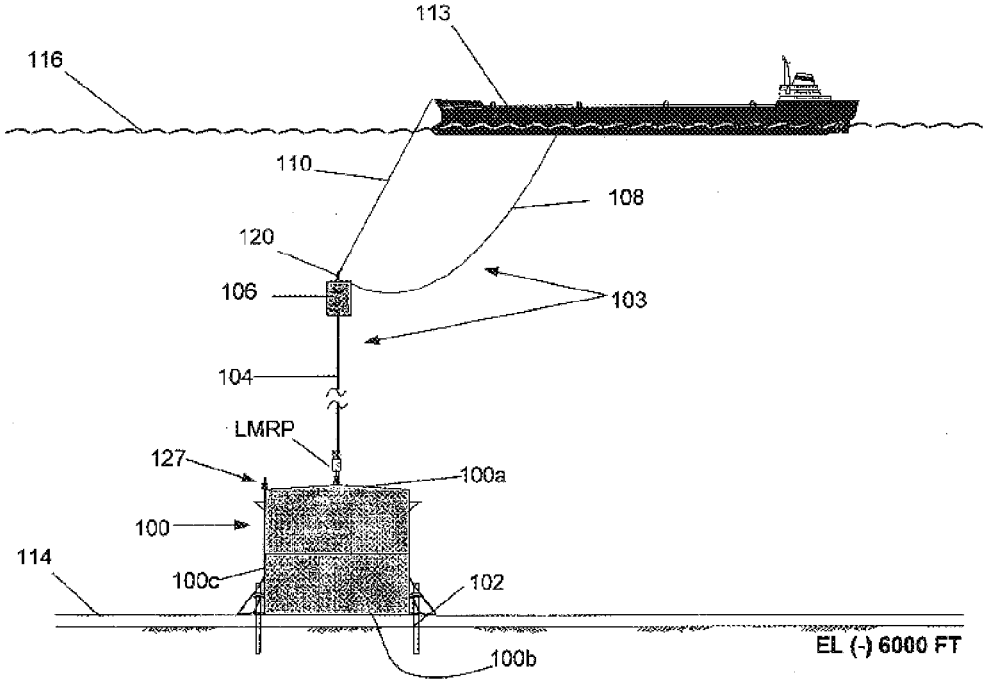
FIG. 4 shows an embodiment of a seabed oil storage and offtake system configured to supply production to a shuttle tanker.

The storage and offtake system further comprises a vessel mooring system which comprises at least one hawser 110. As shown in FIG. 3, the hawser 110 comprises a first end operatively coupled to the tank 100 and a second end adapted to be accessible from the water surface 116. The second end is also adapted to attach to the transport vessel to anchor the transport vessel during offloading operations, as illustrated in FIG. 4.

Referring once again to FIG. 3, suction or conventional piles 102 may be used to attach the tank 100 to the seabed 114 to provide lateral resistance for the tank 100 to sliding due to the slope of the seabed or other lateral forces that may be applied to the storage tank 100 during operation. Additionally, the piles 102 may also act as a restraint for the storage tank 100 which provides mooring for the tanker during offloading operations (illustrated in FIG. 4).

It should be understood that the storage tank 100 may comprise any material suitable for use as a tank such as steel or a composite material such as glass or carbon fiber reinforced plastic. The inside and outside of the tank 100 may also be coated with cement or any other coating material known in the art for protecting structures formed from a metal such as steel against deterioration due to operation in a saltwater environment. Preferably, the storage tank 100 is a gravity based, pressure balanced structure, as will be described in more detail.

The lower portion of the offload line 103 in this embodiment comprises a substantially rigid member, such as a marine riser 104. As shown in FIGS. 3 and 4, the riser 104 in this embodiment comprises a self-standing, top-tensioned riser; wherein one end of the riser 104 connects to the top of the storage tank 100 and the other end of the riser 104 connects to a subsurface buoyant device (for example, subsurface buoy 106) to maintain the riser 104 in tension in a substantially upright position when the system is submerged in water. To facilitate the interface between the lower end of the riser 104 and the top of the tank 100*a*, a Lower Marine Riser Package (LMRP) may be used, such as one available from ABB Vetco-Gray, Houston, Tex., or a similar device. Preferably, the riser 104 also functions as part of the transport vessel mooring system (further described below). In such case, the riser 104 should be designed to withstand the additional forces expected to be imposed on it by mooring a tanker (illustrated in FIG. 4) to the tank 100 via the riser 104. Those skilled in the art will appreciate that the riser 104, or the like, may comprise any material suitable for the particular application, such as steel or a composite material. Additionally, the external surface of the riser 104 exposed to the seawater environment may be coated with a suitable protective material.

As previously described and shown in FIG. 3, a subsurface buoy 106, or other buoyant device, may be attached to the upper end of the riser 104 to maintain the riser 104 in an upright position and in tension. For example, the subsurface buoy 106 illustrated in FIG. 3 may comprise one or more chambers filled with fluid substantially lighter than seawater, such as air or oil, and a center passage there through for the top of the riser 104 to interface with an end of the upper portion of the offload line 103.

Also as shown in FIG. 3, the subsurface buoy 106 and the upper end of the riser 104 are located a selected distance below the water surface 116. This distance, more preferably, is such that the effects of surface environmental loads, such as the wind, waves, and current, on the subsurface buoy 106 and riser 104 will be feasibly minimized. A desirable depth for a particular embodiment is site specific and may be determined by one skilled in the art based on factors such as the structural integrity of a selected riser 104 (e.g., rigidity, length, and tension) and worst case environmental operating conditions, such as a 1-year, 10-year, or 100-year worst storm criteria for the particular sea state. For example, based on the structural integrity of a particular riser and particular storm criteria, a subsurface buoyant device may be located at a depth below the water surface such that the effects of waves and surface currents on the buoyant device is less than 10%, or more preferably less than 2%, of the effect if the buoyant device was located at the water surface 116. In some cases this depth may be at least 50 feet below the water surface 116. In other cases this depth may be at least 200 feet below the water surface 116. However, criteria used to determine the desired depth of the subsurface buoyant device and the selected depth are matters of convenience for a system designer, and not intended as a limitation on the invention. Further, those skilled in the art will appreciate that in the case of the riser 104 used as part of the mooring system (further described below), the tension needed on the riser can be determined based on factors such as the size of the shuttle tanker to be moored, the water depth in which the system is installed, environmental conditions (such as wind, waves, and current) at the particular site, and the worst storm conditions for which the system is designed to function.

The upper portion of the offload line 103 may comprise a flexible member, such as a hose or series of rigid segments (e.g., subpipe sections) coupled by flex joints. In the embodiment shown in FIGS. 3 and 4, the flexible member comprises a hose 108. The hose 108 provides a flexible fluid channel which extends from the top of the riser 104 to the water surface 116. The hose 108 is in fluid communication with the riser 104 through the subsurface buoy 106 to transfer hydrocarbons (oil) from the tank 100 to a transport vessel such as a shuttle tanker (shown as 113 in FIG. 4) or the like. In this embodiment, the lower end of the hose 108 is attached to the top of the riser 104 at the subsurface buoy 106, and the upper end of the hose 108 is attached to a surface buoy 112 so that the hose 108 can be easily accessed from the water surface 116 for offloading (or offtake) operations. Those skilled in the art will appreciate that the flexible upper portion of the offload line 103 may comprise any material suitable for a particular application, such as rubber, metal, composite material, or a combination thereof.

As shown in FIGS. 3 and 4, in one embodiment, the hawser 110 operatively couples to the tank 100 through the riser 104. One end of the hawser 110 is connected to the subsurface buoy 106 at the upper end of the riser 104. The other end of the hawser 110 is connected to the surface buoy 112. As a result, the hawser 110 can be used to anchor a transport vessel, such as a shuttle tanker (113 in FIG. 4) or the like, to the tank 100 during offloading operations, or during servicing of the system. In this embodiment, the hawser 110 is shorter in length than the hose 108, which ensures that the hawser 110, and not the hose 108, provides the anchoring connection between the riser 104 and any vessel connected to the hawser 110 at the water surface 116. Those skilled in the art will appreciate that in other embodiments, the hawser 110 may be operatively coupled to the tank 100 in a manner different than the manner shown in FIGS. 3 and 4, without departing from the spirit of the invention. Those skilled in the art will also appreciate that hawsers for mooring transport vessels and the like are well known in the art and that any type of hawser considered suitable for a particular application by a system designer may be used for the system without departing from the spirit of the invention.

As previously explained with respect to FIGS. 3 and 4, one or more buoyant devices, such as surface buoy 112, may be attached to the upper end of the hose 108 and the upper end of the hawser 110 to maintain the surface ends thereof so that they are easily accessible at the water surface 116. In some embodiments, the storage and offtake system may also include a coupling, such as a flex joint 118 and/or swivel joint 120, disposed between the riser 104 and the hose 108 and/or the riser 104 and the hawser 110 to enable the hose 108 and the hawser 110 to rotate freely with respect to the riser 104. In the embodiment shown in FIG. 3, the flex joint 118 is positioned between the riser 104 and the subsurface buoy 106, and a swivel joint 120 is positioned between the top of the riser 104 and the ends of the hose 108 and hawser 110 proximal the subsurface buoy 106. Additionally, the system may include any connection device known in the art at the accessible end of each of the hose 108 and the hawser 110 for releasably connecting the hose 108 and the hawser 110 to a tanker 113 or other transport vessel during offloading operations.

Now referring to FIGS. 5 and 6, as previously discussed, the storage tank 100 of the system is substantially pressure balanced. This pressure balance can be achieved by providing that the inside of the tank 100 is in fluid communication with the seawater environment outside of the tank 100 at substantially the same depth. Those skilled in the art will appreciate that in the case of a pressure balanced tank 100, the transportation and installation loads, rather than differential pressure across the tank 100 during operation will primarily affect the structural design of the tank 100. This allows for pressure balanced tanks to have substantially reduced wall thickness in comparison to enclosed storage systems on the seabed which are subject to hydrostatic pressure differences across the walls of the tank. This also allows for feasible tanks with larger storage capacities, such as up to 2 million barrels of oil, for deepwater service, such as in depths up to 10,000 feet of water, or more. In a particular embodiment, for example, the tank may have dimensions of about 200 feet long, about 200 feet wide, and about 150 feet tall and may have a capacity around 750,000 barrels. Thus, embodiments of the invention may provide a lower cost option and/or increased storage capacity than other storage systems.

Examples of a pressure balanced tank during normal operations in accordance with the above description are shown in FIGS. 5 and 6. FIG. 5 is an illustration of a storage tank 100 during a "filling" operation. FIG. 6 is an illustration of a storage tank 100 during an "offtake" operation. In the examples shown, the pressure balance is achieved through the use of a fluid channel 127, which extends from a lower location inside of the storage tank 100 through an upper section of the tank 100 and into the surrounding seawater environment 125. The fluid channel 127 allows the interior of the storage tank 100 to be in fluid communication with the seawater environment 125. Hydrocarbons 121 entering the tank 100 will float to the top 100*a* of the tank 100 and become trapped in the riser 104 and the upper portion of the tank 100, thereby displacing water 123 in the tank to the bottom 100*b* of the tank 100.

Those skilled in the art will appreciate that the tank 100 may additionally include instrumentation to ensure that the maximum and minimum oil 121 and water 123 levels for a selected tank design are not exceeded. Those skilled in the art will also appreciate that the fluid channel 127 may comprise any configuration and may communicate with the seawater environment outside of the tank 100 at any location, such as through a side wall of the tank 100, as determined by the system designer without departing from the spirit of the invention. However, in a particular embodiment the fluid channel 127, preferably, is in fluid communication with the surrounding seawater environment 125 at a location away from the seabed (114 in FIGS. 3 and 4), as further discussed below.

As shown in FIG. 5 (and FIG. 6), the fluid channel 127 may extend through the top of the tank 100 to elevate the point of water discharge (and intake) at the external end 124 of the fluid channel 127, away from the seabed (at 114 in FIGS. 3 and 4). Locating the external end 124 of the fluid channel 127 away from the seabed (114 in FIGS. 3 and 4), advantageously, improves the dispersion of seawater exiting the tank and prevents scouring around the base of the storage tank 100. A storage tank 100 with a fluid channel 127 as shown in FIGS. 5 and 6 is functionally the same as an opened bottom tank with respect to pressure-balancing the tank. However, a storage tank 100 with a fluid channel 127 for seawater intake and discharge is more effective because it eliminates problems associated with water dispersion and scouring around the base of the tank 100. Additionally, a storage tank 100 having a fluid channel 127 arrangement as shown may also allow for improved monitoring and control of seawater flow in and out of the storage tank 100 in comparison to open bottom tanks. For example, the system may additionally include instrumentation in or proximal to an end of the fluid channel 127 for monitoring and controlling fluid flow through the fluid channel 127 as determined by the system designer. For instance, a device measuring the resistivity of fluids or residue oil content in the water leaving the fluid channel 127 may be included in the system.

Referring to FIG. 5, during production operations, as hydrocarbons enter the storage tank 100 through the inlet 122, the hydrocarbon/water interface 129 is pushed downward displacing seawater 123 out of the fluid channel 127 and into the surrounding seawater environment 125. It should be understood that in a preferred embodiment, this hydrocarbon/water interface 129 is naturally formed by pumping hydrocarbons (oil) 121 directly on water 123 in the tank and allowing the hydrocarbons 121 to naturally rise to the top of the tank 100 displacing water 123 to the lower section of the tank 100. However, in other embodiments this interface 129 may be mechanically maintained using a flexible or permeable membrane member in the tank which is displaced in the tank as hydrocarbons 121 flow in or out of the tank 100, without departing from the spirit of the invention.

Referring now to FIG. 6, during offtake operations, hydrocarbons 121 in the tank 100 may be offloaded onto a transport vessel, such as a shuttle tanker (113 in FIG. 4) or the like for transport to shore. For example, once the transport vessel is moored using the hawser 110 (in FIG. 4), and the hose 108 (in FIG. 4) is connected to the vessel, a surface valve or other remotely located valve, such as at 128, is opened and the hydrostatic pressure imbalance due to the gravity difference between the hydrocarbon and seawater columns provides the motive force required to force the hydrocarbons 121 up the riser 104 and hose 108 (in FIG. 4) to the transport vessel at the surface 116. Thus, advantageously, no pump is required to lift the hydrocarbons 121 from the storage tank 100 to the shuttle tanker (113 in FIG. 4) during the offtake operation. The energy available to transport hydrocarbons 121 up the offload line 103 (in FIG. 4) is substantially equal to the hydrostatic pressure difference between the hydrocarbons 121 and seawater 123 columns. For example, for a 30° API oil stored in a tank at a 6,000-foot water depth, the differential pressure between the fluid columns will be about 325 psi, which is more than sufficient to move the hydrocarbons 121 up the offload line 103 (in FIG. 4) and into a tanker 113.

Now referring again to FIG. 3, one skilled in the art will appreciate that to install a seabed storage tank 100 at a location offshore, the tank 100 may be filled with a fluid lighter than seawater, such as light oil, in protective water and towed to a desired location. Seawater may then be pumped into the tank 100 while displacing the light oil to sink the tank 100 to the seabed 114. The displaced light oil may be recovered and stored in an accompanying tank. For example, once at the desired surface location, seawater may be pumped into the inlet 122 of the tank 100 until the weight of the seawater plus the weight of the tank 100 is sufficient to overcome the buoyancy force on the tank 100 which initially is full of light oil. Once the buoyancy of the tank 100 is properly adjusted with light oil and seawater, tank 100 is lowered to the seabed. Once the tank 100 is in place on the seabed 114, the piles 102 around the tank 100 are installed and the offload line 103, the inlet lines (at 122), and the remaining system components are connected to the tank 100.

Figure 7:
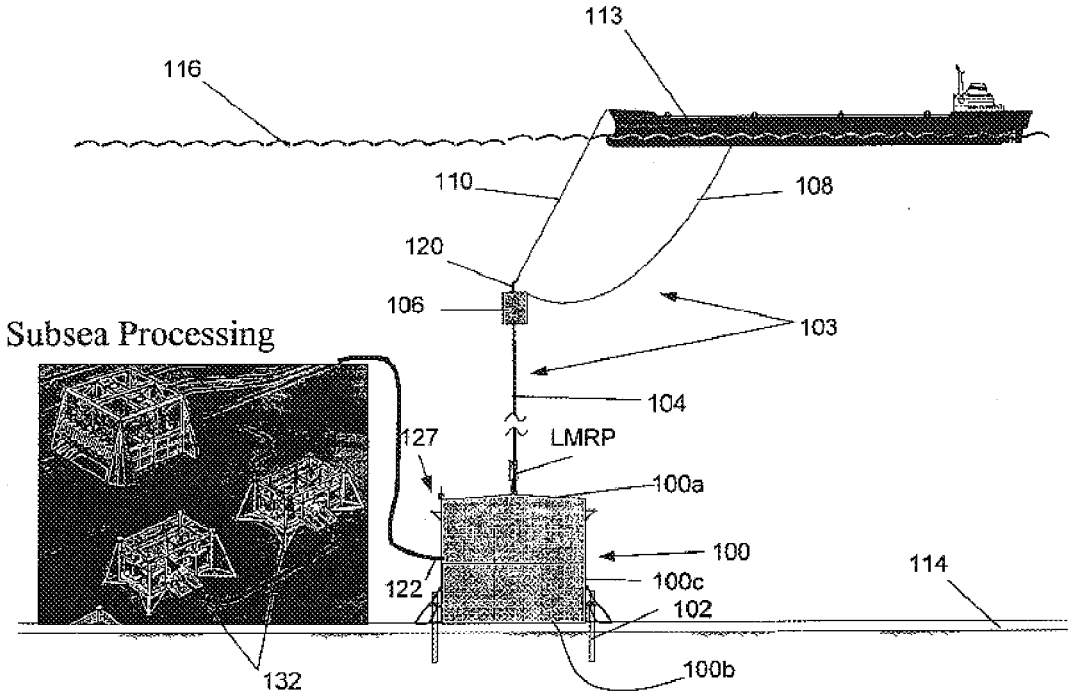
FIG. 7 shows an embodiment of a seabed oil storage and offtake system used in connection with a subsea processing system.
Figure 8:
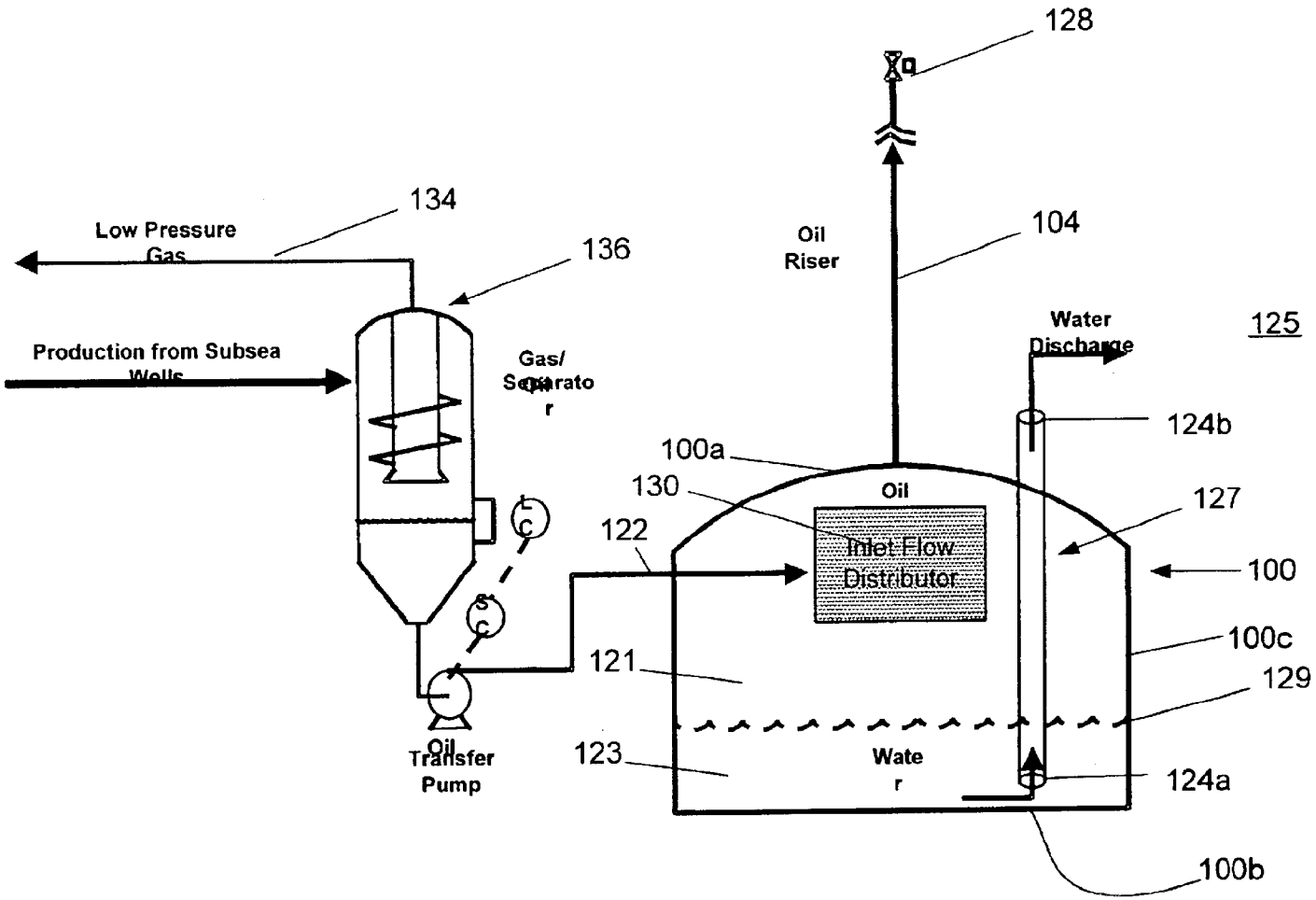
FIG. 8 shows an embodiment of a seabed oil storage and offtake system used in connection with a subsea processing system.

Embodiments of a storage and offlake system may be used in conjunction with a subsea processing and/or gathering system as illustrated in FIGS. 7 and 8. For example, the subsea processing system may comprise a subsea oil and gas separator 136 for degassing liquid hydrocarbons produced from the subsea wells 132 (in FIG. 7). An example of a subsea processing system is described in U.S. Pat. No. 6,537,349 issued to Choi et al., and entitled "Passive Low Pressure Flash Gas Compression System". As shown in FIG. 8, when an embodiment of the invention is used with a subsea processing system, gas 134 separated from the liquid hydrocarbons may be routed to a gas handling system and the liquid hydrocarbons (oil) 121, exiting the separator 136 at a lower pressure can then be pumped via oil transfer pumps 135 into the inlet 122 of the tank 100.

Figure 9:
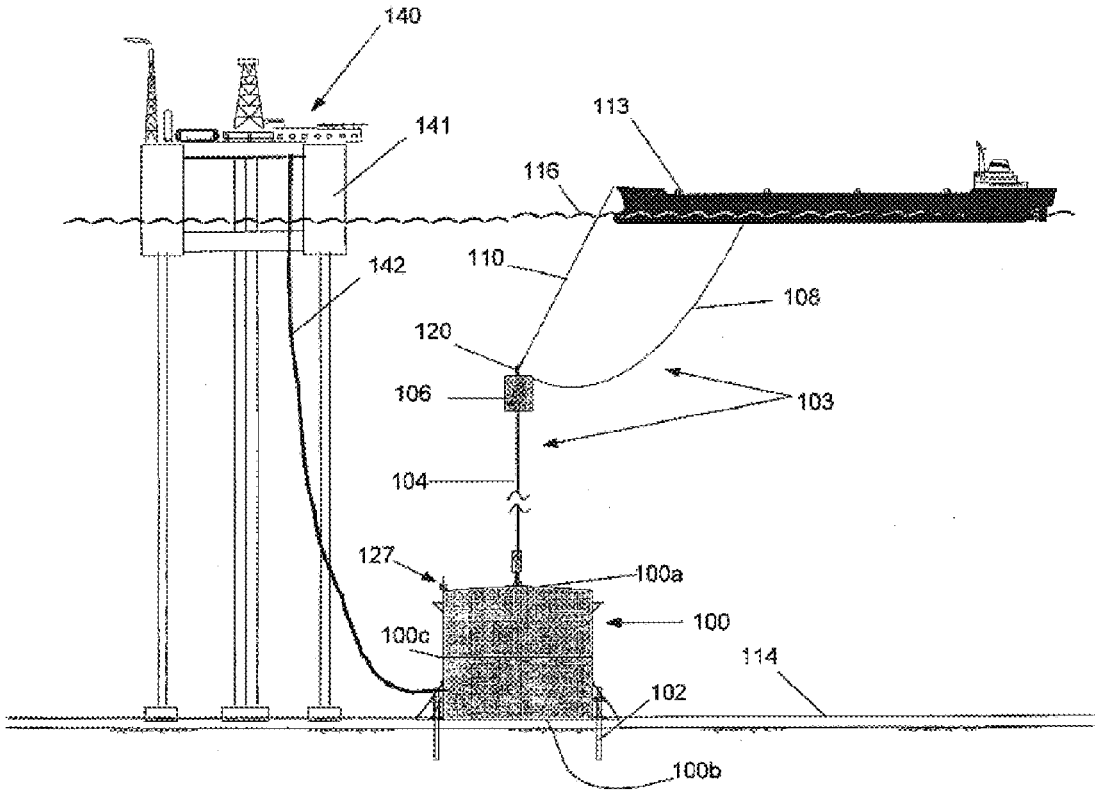
FIG. 9 shows an embodiment of a seabed oil storage and offtake system used in connection with a tension leg platform.

A seabed storage and offtake system in accordance with the invention may also be used in conjunction with an offshore production platform as a cost-effective option for providing storage or additional storage for processed hydrocarbons. For example, FIG. 9 shows one embodiment of a seabed storage system used in conjunction with a conventional tension leg platform (TLP) 140. The TLP may include storage facilities at 141 for storing a limited amount of processed hydrocarbons. In this example, hydrocarbons from the TLP 140 are conveyed to the seabed storage tank 100 through a supply riser 142 which extends from the platform 140 to the tank 100. As discussed above, the pressure of the hydrocarbons entering the seabed storage tank 100 must be adequate to overcome the hydrostatic pressure at the external end 124 of the fluid channel 127. However, with the help of the hydrocarbon column in the supply riser 142 from the platform to the tank 100, the pumping energy required at the platform to transfer oil to the seabed storage tank 100 is significantly less than that for subsea processing.

Figure 10:
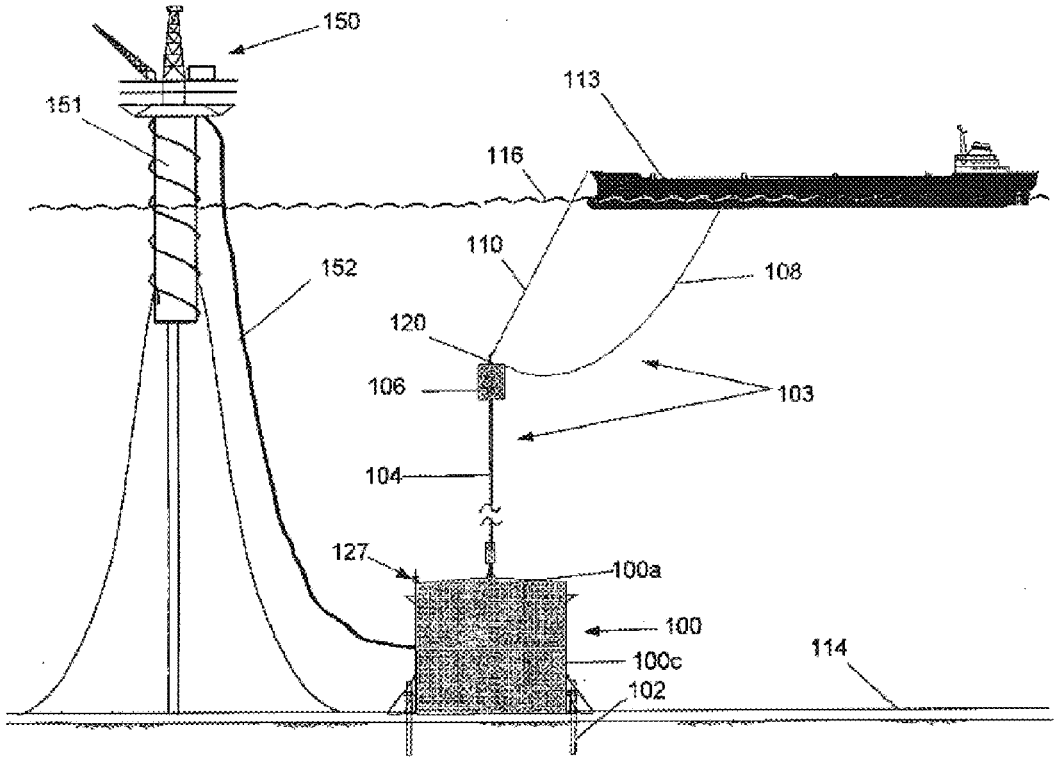
FIG. 10 shows an embodiment of a seabed oil storage system used in connection with a SPAR platform.
Figure 11:
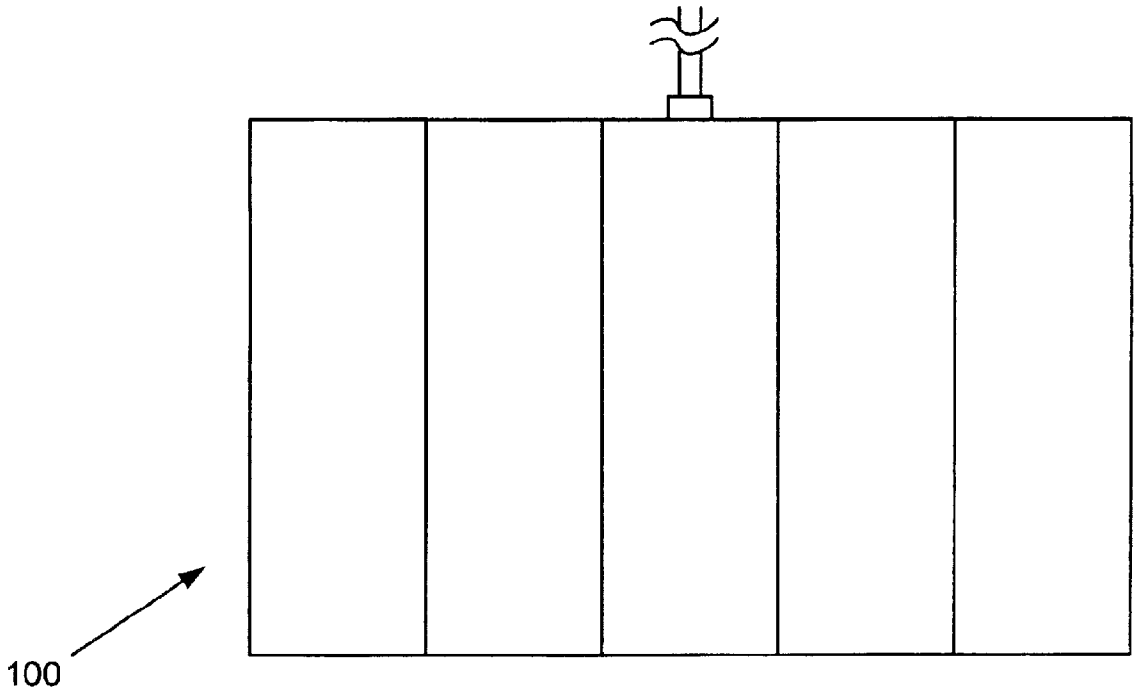
FIG. 11 shows an embodiment of a seabed oil storage system having a box-shaped web-frame steel structure.

An example of a seabed storage system used in conjunction with a SPAR platform 150 is shown in FIG. 10. The platform 150 includes an integral storage vessel at 151 which may be used to store a limited amount of hydrocarbons. Similar to the previous example, stabilized oil is pumped from the SPAR platform 150 into a supply riser 152 feeding the seabed storage tank 100. As discussed above, with the help of the oil column in the supply riser 152 leading to the inlet of the tank 100, the pumping energy required at the platform 150 to transfer oil to the seabed storage tank 100 is significantly less than that for subsea processing.

One skilled in the art will appreciate that a subsea storage and offtake system may comprise a plurality of subsea tanks connected in series or parallel, as determined by the system designer without departing from the spirit of the invention. For example, one or more tanks may be connected to the tank 100 shown in FIGS. 3 and 4, such that when the water level in the tank 100 reaches a minimum level, hydrocarbons pumped into the tank will overflow into another tank. Alternatively, the group of smaller tanks may be connected in parallel, such that their capacities equal that of a larger tank and act like a single vessel with a common oil and water interface level. Methods for configuring a system to include a plurality of tanks connected in parallel or in series are known in the art.

Embodiments of the invention may include one or more of the following advantages. Embodiments of the invention may be used to provide "on-site" storage for offshore production so that large amounts of hydrocarbons can be continually produced during adverse weather conditions and avoid the need for a shuttle tanker to be stationed at the production site at all times. Embodiments of the invention may also be used in conjunction with a subsea processing system and/or a production platform. Embodiments of the invention may also be used to eliminate the need for costly deepwater pipelines to shore, and in some cases may be used to avoid expensive pipeline tariffs. Embodiments of the invention may also provide larger storage capacity for offshore production sites in deepwater that are less costly to operate and maintain than prior art storage systems primarily dependent upon shuttle tankers or submerged thick walled storage vessels. Embodiments of the invention may also be used to reduce the number of shuttle tankers required in a hydrocarbon transport fleet. These advantages are only examples of advantages that may be associated with one or more embodiments of the invention. Thus, the invention is not intended to be limited to any of the advantages noted above.

While the invention has been described with respect to a limited number of embodiments, those skilled in the art will appreciate that other embodiments can be devised which do not depart from the spirit of the invention as disclosed. Accordingly, the scope of the invention should be limited only by the attached claims.

What is claimed is:

1. An oil storage and offtake system, comprising:

a storage tank attachable to a seabed and adapted to store hydrocarbons therein;

at least one fluid channel having a first end positioned inside of the tank proximal a bottom of the tank and a second end in fluid communication with seawater outside of the tank;

at least one offload line having a first end coupled to and in fluid communication with the tank proximal a top of the tank and a second end adapted to be fluid coupled to a tanker and accessible from a water surface, wherein the at least one offload line comprises a substantially rigid lower portion coupled to the tank and extending therefrom to a selected depth below the water surface, and a flexible upper portion coupled to and in fluid communication with the lower portion and extending therefrom to proximal the water surface, wherein the lower portion comprises a top-tensioned riser maintained in tension by a subsurface buoyant device coupled to the riser, wherein the flexible upper portion of the at least one offload line is coupled proximal one end to a surface buoyant device for access from the water surface; and at least one hawser having a first end operatively coupled to the tank at a location below the water surface and a second end coupled to the surface buoyant device, wherein the at least one hawser has a length less than a length of the flexible upper portion of the at least one offload line, wherein the second end of the at least one hawser is adapted to be accessible from the water surface and attachable to the tanker to anchor the tanker during offtake operations.

2. The system of claim 1, wherein the tank is adapted to store oil on water in the tank, the water in fluid communication with a seawater environment outside of the tank, a level of water in the tank corresponding to an amount of oil pumped into and withdrawn from the tank.

3. The system of claim 1, wherein the second end of the at least one fluid channel is disposed at a location away from the seabed.

4. The system of claim 1, wherein the first end of the at least one hawser couples to the subsurface buoyant device.

5. The system of claim 1, further comprising at least one coupling device between the riser and the first end of the hawser adapted to allow substantially free relative rotation of the hawser with respect to the riser.

6. The system of claim 1, wherein the flexible upper portion of the at least one offload line comprises a hose.

7. The system of claim 1, wherein the subsurface buoyant device is located at a depth below the water surface such that the subsurface buoyant device is substantially unaffected by waves and surface currents produced by a selected storm magnitude.

8. The system of claim 7, wherein the selected storm magnitude is a 1-year storm magnitude for a particular sea state.

9. The system of claim 7, wherein the selected storm magnitude is a 10-year storm magnitude for a particular sea state.

10. The system of claim 1, wherein the subsurface buoyant device is located at least about 50 feet below the water surface.

11. The system of claim 10, wherein the subsurface buoyant device is located at least about 200 feet below the water surface.

12. The system of claim 1, wherein the subsurface buoyant device comprises an opening therein to accommodate coupling of the upper portion of the offload line with the riser.

13. The system of claim 12, further comprising a coupling device between the riser and the subsurface buoyant device adapted to allow rotation of the subsurface buoyant device with respect to the riser.

14. The system of claim 12, further comprising at least one coupling device between the riser and the first end of the upper portion of the offload line adapted to allow substantially free relative rotation of the upper portion of the offload line with respect to the riser.

15. The system of claim 1, further comprising weighting material disposed in the tank, the weighting material having sufficient weight to overcome buoyancy forces on the tank when the tank is filled to a capacity with hydrocarbons.

16. The system of claim 15, wherein the weighting material comprises sand.

17. The system of claim 1, further comprising weighting material attached to the tank, the weighting material having sufficient weight to overcome buoyancy forces on the tank when the tank is filled to a capacity with hydrocarbons.

18. The system of claim 1, wherein the storage tank is a pressure balanced vessel having a box-shaped configuration with a web-framed steel structure and stable flotation for open-water tow.

19. The system of claim 1, wherein the capacity of the tank is greater than 500,000 barrels.

20. The system of claim 19, wherein the capacity of the tank is around 750,000 barrels.

21. The system of claim 1, wherein that tank comprises dimensions of around 200 feet long, around 200 feet wide, and around 150 feet tall.

22. An oil storage and offtake system comprising:

a storage tank attachable to a seabed and adapted to store hydrocarbons therein;

at least one fluid channel having a first end positioned inside of the tank proximal a bottom of the tank and a second end in fluid communication with an environment proximal the outside of the tank away from a base of the tank;

a tensioned riser in fluid communication with the tank, the riser having a first end coupled to the tank proximal a top of the tank, the riser extending therefrom to a second end at a selected depth below a water surface, the riser coupled proximal the second end to a subsurface buoy to maintain the riser in tension;

a flexible hose in fluid communication with the riser, the hose having a first end coupled to the second end of the riser, the hose having a second end coupled to a surface buoy and accessible from the water surface, the second end of the hose adapted to fluid couple to a tanker;

at least one hawser having a first end coupled to the second end of the riser and a second end coupled to the surface buoy and accessible from the water surface, the hawser having a length less than a length of the hose, the second end of the at least one hawser adapted to attached to the tanker to moor the tanker during offtake operations;

at least one coupling device between the second end of the riser and the first end of each of the hose and the hawser adapted to allow substantially free relative rotation of the hose and the hawser with respect to the riser; and weighting material disposed in the tank, the weighting material having sufficient weight to overcome buoyancy forces on the tank when the tank is filled to a capacity with hydrocarbons.

23. The system of claim 22, wherein the weighting material comprises sand.

24. The system of claim 22, wherein that tank comprises dimensions of around 200 feet long, around 200 feet wide, and around 150 feet tall and has a capacity of about 750,000 barrels.

* * * * *

UNITED STATES PATENT AND TRADEMARK OFFICE

CERTIFICATE OF CORRECTION

PATENT NO. : 6,817,809 B2 
DATED : November 16, 2004
INVENTOR(S) : Michael S. Choi, Jack H-C. Chan and David P. Tuturea It is certified that error appears in the above-identified patent and that said Letters Patent is hereby corrected as shown below:

Column 2,
Line 60, please delete "fall" and insert -- full --

Signed and Sealed this

Fifth Day of July, 2005

JON W. DUDAS
*Director of the United States Patent and Trademark Office*